US009724721B2

(12) United States Patent
Dubrovsky

(10) Patent No.: US 9,724,721 B2
(45) Date of Patent: Aug. 8, 2017

(54) PNEUMOACOUSTIC BAR ATOMIZER

(71) Applicant: Andrey Nikolaevich Dubrovsky, Moscow (RU)

(72) Inventor: Andrey Nikolaevich Dubrovsky, Moscow (RU)

( * ) Notice: Subject to any disclaimer, the term of this patent is extended or adjusted under 35 U.S.C. 154(b) by 0 days.

(21) Appl. No.: 14/759,657

(22) PCT Filed: Aug. 15, 2013

(86) PCT No.: PCT/RU2013/000705
§ 371 (c)(1),
(2) Date: Jul. 8, 2015

(87) PCT Pub. No.: WO2015/012716
PCT Pub. Date: Jan. 29, 2015

(65) Prior Publication Data

US 2015/0343478 A1 Dec. 3, 2015

(30) Foreign Application Priority Data

Jul. 26, 2013 (RU) ..... 2013134991

(51) Int. Cl.
*B01F 3/04* (2006.01)
*B05B 17/06* (2006.01)

(52) U.S. Cl.
CPC ..... *B05B 17/06* (2013.01); *B01F 3/04049* (2013.01); *B01F 3/04056* (2013.01); *B05B 17/0692* (2013.01)

(58) Field of Classification Search
CPC .... B01F 3/04; B01F 3/04007; B01F 3/04021; B01F 3/04049; B01F 3/04056
USPC ..... 261/78.2; 239/589.1
See application file for complete search history.

(56) References Cited

U.S. PATENT DOCUMENTS 3,371,869 A * 3/1968 Hughes ..... F23D 11/34 123/198 E
6,669,115 B2 * 12/2003 Sun ..... B05B 1/265 239/403

* cited by examiner

*Primary Examiner* — Robert A Hopkins
(74) *Attorney, Agent, or Firm* — Joseph E. Maenner; Maenner & Associates, LLC

(57) ABSTRACT

A mechanical device used to atomize liquids. The device eliminates circular instability at elevated generation frequencies, producing drops of 30-40μ. This is achieved when the central bar has been made with the diameter equal to the diameter of the nozzle. The longitudinal grooves in the central bar are located at the distance which does not exceed the quarter of the wave length of the nozzle working frequency. The depth of grooves at the central bar 8, their width t, number n, the generation frequency f, the width of the resonance groove of the pneumoacoustic bar nozzle a and the distance between the circular gas nozzle H and the bottom of the ring-like resonator were selected based on the ratio:

$$S=n\cdot 8\cdot t,$$

Figure 1:
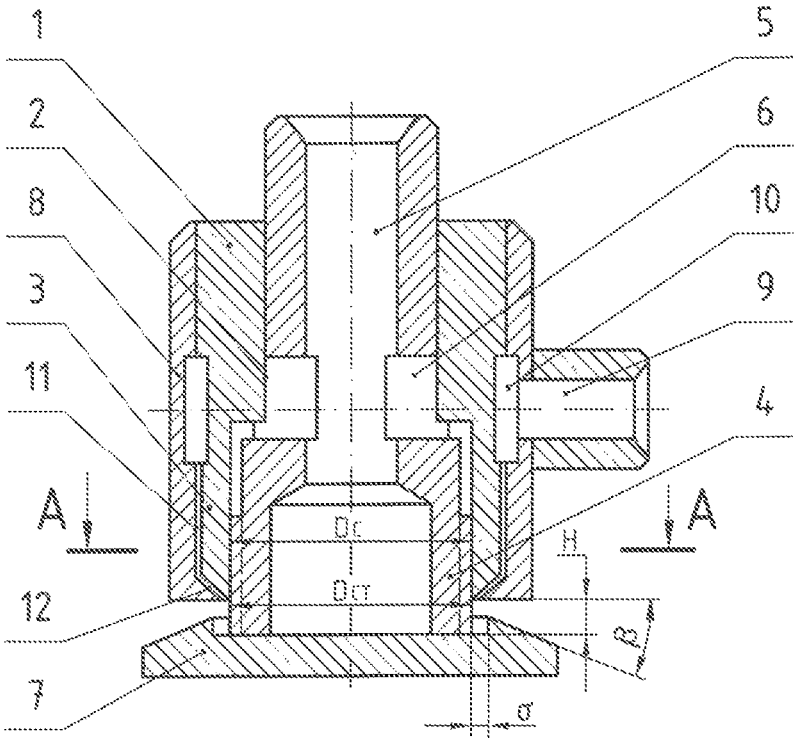

where S is the aggregate cross section of grooves upon the preset gas efficiency;

$$12.5\sim f\cdot 8\sim 15;$$

$$1.8\sim a/8\sim 2.1;$$

$$7\sim H/8\sim 8.$$

3 Claims, 1 Drawing Sheet

PNEUMOACOUSTIC BAR ATOMIZER

The invention refers to mechanical liquid spraying devices which utilize impulse waves created by the resonating cavity upon braking action of supersonic underexpanded gas jets and which may be used for fogging the rooms in order to moisturize air in weaving shed, glasshouses and for disinfecting medical rooms through the use of the bactericides solutions.

Well known is the pneumoacoustic atomizer incorporating the resonant cavity, gas and water nozzles, the bar, mounted with the gap towards the gas nozzle, which differs from others by the structure according to which the size of the gap has been selected as $\delta=(0.03\text{-}0.055)\ \lambda$, and the resonant cavity depth is $h=(3.0\text{-}5.0)\ 6$, when $\lambda$-is the length of the acoustic radiation wave at the inert gas operational frequency. Russian Federation Patent No 2130328, МПК: A62C3/00, A62C35/00, A62C31/02, B05B7/06, 1999.

Well known is also the acoustic nozzle embedding the body with incorporated generator of acoustic oscillations shaped as the resonant cavity; and nozzles for supply of air and liquids, which body is made from upper cylindrical and bottom parts, connected, at least, by two bars; in this scheme, the upper cylindrical part contains nipple with cylindrical and conical coaxial holes for delivery of agent to be atomized, for example, air. Inside the nipple, there is coaxial nozzle with the central hole to deliver liquids. The nozzle is fixed by the fixing discs made as, at least, three resilient blades communicating with the internal cylindrical surface of the hole (used to supply air), while the bottom part of the body is the ring-like resonator with internal cylindrical cavity coaxial to nozzle where the central liquid supply hole ends at the resonator edge, made as the cup with the conical surface at the side of the nozzle, used for supply of liquid. The cup is made as the integral body with the ball segment of the conical surface transiting into the circular surface of the resonator. Relationship of the height $h_1$ of the resonator cavity and the distance h between the edge of the resonator and bottom frontal surface f of the nozzle used to supply air is measured by the scale of values $h_1/h=0.5\div1.5$; the relationship of the internal diameter $d_1$ of the resonator to diameter $d_2$ of its external cylindrical surface is within the range of values: $d_1/d_2=0.7\div0.9$; relation of the internal resonator diameter $d_1$ to the diameter d of the nozzle supplying liquids is within the interval of values: $d_1/d=1\div3$; whilst the relationship of the resonator internal diameter $d_1$ to the height $h_1$ of the resonator cavity is measured within the scale of values, i.e. $d_1/h_1=1\div1.5$.

We know the acoustic atomizer for solutions which has the hollow body with walls made by the conical and frontal surfaces embedding resonator and cavity for atomizing agent (shaped as the frastum of cone having large and smaller basement) and the hollow cylindrical bar mounted over the floor. The distribution head supplying the solution is mounted on the hollow cylindrical bar connected to the body. The circular gap is provided between the bar and the body at the side of the small basement of the frustum cone, thus creating the cavity and the resonator is made as the spherical cavity, located in the frontal wall of the body and facing the distribution head. The spherical head is connected by the calibrated hole to the gap between the vertical holes in the frontal wall of the body and rod of the distributing head. The gap has (in the crosscut perpendicular to the axis of the rod) the ring-type cross cut and the distributing head has been made as the body with the lid in the shape of frustum cones, connected to large basements. The body contains the collector, shaped as the cylindrical cavity, connected by the circular channel, created by the external cylindrical surface of the hollow rod and coaxial holes of the same diameter, made in the lid, and the body of the distribution head and with the three channels for solution output equally placed along the perimeter and perpendicular to rod's axis. The edge of the holes locates at the conical surface of the distribution head lid, which inclination angle determines the corner angle of the torch of the atomized solution. Russian Federation Patent No 2336129, МПК: B05B17/06, 2008. The above mentioned nozzles have the common drawback, i.e. it not possible to get the drops less than 50 um.

We also know the pneumoacoustic nozzle having the body with the end-to-end liquids delivering channel. It has been installed at one side of the sleeve, delivering gas to the central section of the liquid supplying channel, and the outlet nozzle, mounted on the other side of the body. Collector cavity was made around the body, connected by the radial holes, with the liquid supplying channel. Gas delivering nipple has been installed on the collector cavity and the outlet nozzle connects to the ring-like chamber, mounted on the body which embraces the liquid supplying channel. The additional gas supply nipple is mounted on the ring-like chamber. The toroidal generator of acoustic vibrations is installed between the outlet nozzle and the ring-like chamber. Russian Federation Patent No 110000, МПК: B05B17/00, 2011.

Well known is also the pneumoacoustic bar atomizer of liquids incorporating the cylindrical body which has the central hole with inlet gas channel, central bar inserted into the central hole which part projects from the cylindrical body and which has the inlet channel for liquids, liquid circular chamber, connected to inlet channel for liquids, gas nozzle connected to liquid circular chamber, gas nozzle around the central rod, ring-like resonator mounted on the protruding section of the central bar which working surface faces the gas nozzle and both gas and liquid nozzles are coaxial. The liquid nozzle locates further on along the radius from the central axial line of the cylindrical body; the feedwell embraces the cylindrical body. The liquid circular chamber and liquid supplying nozzle were made by the grooves in the cylindrical body, limited by the internal surfaces of the feedwell, in which the inlet gas nozzle has been made cylindrical while the central rod—profiled. The part, located inside the body, is conical and the place, where rod parts converge, sits on the nozzle edge. Channel for liquids is made as the nipple mounted on the external surface of the feedwell and connected to the liquid circular chamber. Russian Federation Patent 2467807, МПК: B05B17/04, 2012. Prototype model. The prototype model has the deficiency, i.e. when the frequency is increased through the thinning of the circular jet, the circular instability occurs thus making impact on the vibrations' amplitude, determining the degree of dispersion.

The main task of this invention is to create pneumoacoustic bar nozzle producing drops of 30-40 um, eliminate circular instability and provide opportunity to work upon the elevated frequencies of regeneration.

The technical result of the invention is the elimination of circular instability on the elevated frequencies of generation and production of dispersion drops of 30-40 um.

The technical result is achieved through the scheme according to which the pneumoacoustic bar nozzle, containing cylindrical body, which has the central cylindrical hole with the inlet gas channel, the central bar, inserted into the central hole and having the part projecting from the cylindrical body, which has the inlet channel for liquids, liquid circular chamber, connected to inlet channel for liquids, nozzle for liquids, connected to the liquid circular chamber embracing the central bar, circular resonator, mounted on the protruding section of the central bar, the working part of which faces the cylindrical body. The gas nozzle and the nozzle for liquids are coaxial; the nozzle for liquids is located further on along the radius when measured from central axis line of the cylindrical body, and the feedwell embraces the cylindrical body. The liquid circular chamber and the nozzle for liquids are made by the grooves in the cylindrical body, limited by the internal surface of the feedwell. The central bar is made with the diameter equal to the diameter of the nozzle and the longitudinal grooves in the central bar are located at the distance which does not exceed the quarter of the wave length of the nozzle working frequency. The depth of grooves at the central bar is expressed through δ, their width –t and number n, frequency of generation is f, the width of the resonance groove of the pneumoacoustic bar nozzle is G and the distance between the circular gas nozzle H and the bottom of the ring-like resonator were selected from the ratio:

$$S=n\cdot\delta\cdot t,$$

Where S is the aggregate cross section of grooves upon the preset gas efficiency;

$$12.5\leq f\cdot\delta\leq 15;$$

$$1.8\leq\sigma/\delta\leq 2.1;$$

$$7\leq H/\delta\leq 8.$$

Figure 2:
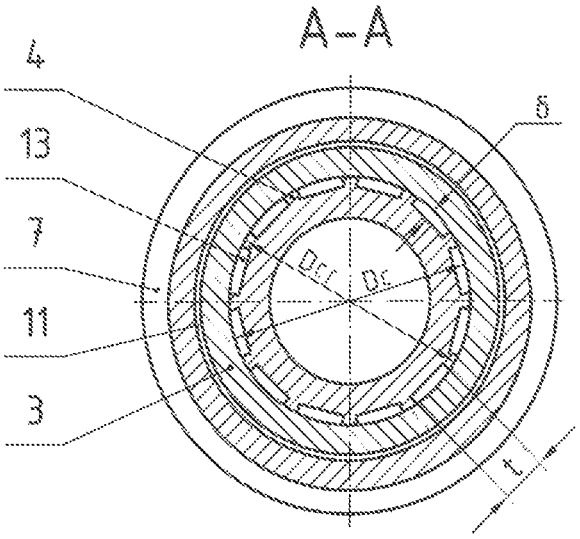

The main idea of the invention has been explained on FIG. 1 and FIG. 2.

FIG. 1 shows the longitudinal cross section of the proposed device, where 1 is the cylindrical body, 2—the central body, 3—the cylindrical gas nozzle, 4—the central bar, 5—the inlet channel, 6—end-to-end gas channels, 7—the ring-like resonator in the shape of a disc with cylindrical bore protruding behind the cylindrical gas nozzle 3, 8—feedwell, embracing the body 1; 9 is the inlet nipple, supplying liquids, which is mounted on the feedwell 8; 10 is the distribution ring-like chamber; 11—the circular liquid channel; 12—circular nozzle for liquids; H—the distance between the circular gas nozzle and the bottom of the ring-like resonator 7; σ is the width of the resonant groove of the nozzle.

FIG. 2 shows the cross section of the nozzle before the gas\liquid outlet from the gas\liquid nozzles, where 3 is the cylindrical gas nozzle; 7—ring-like resonator shaped as the disc; 11—circular liquid channel; 13—longitudinal grooves of the depth δ and width t.

The pneumoacoustic bar nozzle operates according to the following mode:

Gas enters through the gas channel 5 and the feed through gas channels 6 (under the over critical pressure) to the nozzle, created in the bar 4 by the system of longitudinal grooves 13. At the nozzle edge 3, the flat isolated jets have the Mach number equal to one. Drum-like structure, emerging inside each of the flat isolated jets, is slowed down by the ring-like resonator 7. The compression wave appears before the ring-like resonator while after it there is the subsonic flow zone. The area between the flat wave and the resonator bottom 7 makes up the quarter-wave "virtual" resonator which determines the nozzle generation frequency.

The reinforcement of vibrations in this zone results in emergence of blast waves on the surface of jets and these waves are emitted in the surrounding space and, in particular, creating capillary waves on the top surface of the liquid film flowing out of the nozzle for liquids 12, separating the liquid drops and making the fog in the treated room.

The frequency of acoustic vibrations' generation f is determined by the thickness of a jet at the nozzle edge 3. Selecting the depth of the longitudinal grooves 13 it is possible to determine the dispersity of the produced drops. The average size of the produced drops is equal to $0.3\lambda_K$, where the length of the capillary wave is $\lambda_K \cong f^{-2/3}$.

The depth δ of the longitudinal grooves 13 on the central bar 4 and the acoustic vibrations' frequency f are bound by the ratio $\delta=\gamma/f$, where δ is measured in mm, f—in kHz, and the coefficient γ for the ultrasonic range of frequencies often equal to 13.8±1.1 and it depends on the pressure of the atomizing gas $P_0$, while the width of grooves t and their number n is determined by the aggregate cross section of grooves $S=n\cdot\delta\cdot t$ upon the preset efficiency of the nozzle using gas $Q_g$(kg/s): $Q_g=0.4\ P_a\cdot S\cdot T^{1/2}$, where $P_a$ is the absolute gas pressure (kg/cm$^2$), T—absolute gas temperature (K), S (cm$^2$). The generation frequency of acoustic vibrations f actuated in the pneumoacoustic bar nozzle depends also on the geometric parameters of the resonator.

For efficient work of the pneumoacoustic generator, embedding the gas nozzle and the resonator, the width of the resonance groove σ (FIG. 1) was selected within the range (1.8-2.1) δ, and the distance between the circular gas nozzle and the resonator H was selected in the range (7-8) δ.

The invention claimed is:

1. A pneumoacoustic nozzle comprising:

a cylindrical body having a central cylindrical hole and an inlet gas channel extending therethrough;

a central bar inserted into the central cylindrical hole and having a part projecting from the cylindrical body, and having an inlet channel for liquids;

a liquid circular chamber in fluid communication with the inlet channel for liquids;

a nozzle for liquids in fluid communication with the liquid circular chamber and embracing the central bar;

a ring-like resonator mounted on the projecting part of the central bar, which working part faces the cylindrical body, the working part having an annular resonance groove formed therein wherein the gas nozzle and the nozzle for liquids are coaxially installed, the nozzle for liquids being located further on along a radius as measured from a central axis line of the cylindrical body;

a feedwell having an internal surface, the feedwell embracing the cylindrical body, forming a circular chamber and nozzle for liquids are made by longitudinal grooves in the cylindrical body, the grooves being limited by the internal surface of the feedwell, wherein the central bar has a diameter equal to the diameter of the gas nozzle and the longitudinal grooves are separated from each other by a distance that does not exceed a quarter length of a working frequency of the gas nozzle.

2. The pneumoacoustic nozzle according to claim 1, wherein a depth of each groove at the central bar is δ, the width of each groove is t, a number of the grooves is n, a generation frequency is f, the resonance groove having a width σ, and a distance H between the circular gas nozzle and a bottom of the resonance groove were selected based on the ratio:

$$S=n\cdot\delta\cdot t,$$

Where S is an aggregate cross section area of the grooves;

$$12.5 \leq f \cdot \delta \leq 15$$

$$1.8 \leq \sigma/\delta \leq 2.1;$$

$$7 \leq H/\delta \leq 8.$$

3. The pneumoacoustic nozzle according to claim 2, wherein the nozzle generates drops having a size between about 30 microns and about 40 microns.

* * * * *